US009146021B2

(12) United States Patent
Moser et al.

(10) Patent No.: US 9,146,021 B2
(45) Date of Patent: Sep. 29, 2015

(54) DEVICE FOR FASTENING AND CONTACTING A LIGHTING MEANS AND/OR A LIGHTING MODULE, AND LAMP

(75) Inventors: Peter Moser, Stans (AT); Thomas Riedler, Baumkirchen (AT)

(73) Assignee: TRIDONIC GMBH & CO KG, Dornbirn (AT)

( * ) Notice: Subject to any disclaimer, the term of this patent is extended or adjusted under 35 U.S.C. 154(b) by 142 days.

(21) Appl. No.: 14/110,396

(22) PCT Filed: Apr. 3, 2012

(86) PCT No.: PCT/AT2012/000087
§ 371 (c)(1),
(2), (4) Date: Dec. 16, 2013

(87) PCT Pub. No.: WO2012/135877
PCT Pub. Date: Oct. 11, 2012

(65) Prior Publication Data

US 2014/0092608 A1 Apr. 3, 2014

(30) Foreign Application Priority Data

Apr. 8, 2011 (AT) ..... GM204/2011
Aug. 1, 2011 (AT) ..... GM434/2011

(51) Int. Cl.

| | |
|---|---|
| ***F21V 15/01*** | (2006.01) |
| ***F21V 19/00*** | (2006.01) |
| ***F21V 29/507*** | (2015.01) |
| ***F21V 29/77*** | (2015.01) |
| ***F21K 99/00*** | (2010.01) |
| *F21V 19/04* | (2006.01) |
| *F21Y 101/02* | (2006.01) |

(52) U.S. Cl.
CPC ..... *F21V 15/012* (2013.01); *F21K 9/30* (2013.01); *F21V 19/0005* (2013.01); *F21V 29/507* (2015.01); *F21V 29/77* (2015.01); *F21V 19/045* (2013.01); *F21Y 2101/02* (2013.01)

(58) Field of Classification Search
CPC ..... F21V 15/012; F21V 29/507; F21V 29/77; F21V 19/0005
USPC ..... 362/369, 294
See application file for complete search history.

(56) References Cited

U.S. PATENT DOCUMENTS

| | | | | |
|---|---|---|---|---|
| 2008/0224166 | A1* | 9/2008 | Glovatsky et al. | 257/99 |
| 2010/0127637 | A1 | 5/2010 | Alexander et al. | |
| 2010/0302777 | A1 | 12/2010 | Knoll et al. | |

FOREIGN PATENT DOCUMENTS

| | | | |
|---|---|---|---|
| DE | 102007050893 | A1 | 4/2009 |
| EP | 2284440 | A1 | 2/2011 |
| WO | 2010146513 | A1 | 12/2010 |
| WO | 2011019945 | A1 | 2/2011 |
| WO | 2011139538 | A2 | 11/2011 |

* cited by examiner

*Primary Examiner* — David V Bruce
(74) *Attorney, Agent, or Firm* — Volpe and Keonig, P.C.

(57) ABSTRACT

A device is provided for fastening and contacting a illuminant and/or a lighting module, the device including at least one socket housing. The illuminant and/or lighting module are/is arranged in the socket housing of the device. The illuminant and/or lighting module include/s at least two contacting elements, which are arranged separately from each other on the illuminant and/or lighting module and which are each electrically contacted by a respective individual contact of the socket housing. The device includes an adapter element having at least one collective contact point, wherein at least one electrical connection is present. An individual contact of the socket housing and a contact of a collective contact point are connected by means of an electrical connection. A lamp including the device is also presented.

12 Claims, 6 Drawing Sheets

Fig. 10a
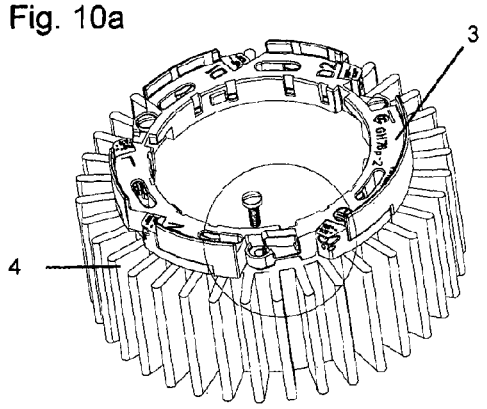
Fig. 10b
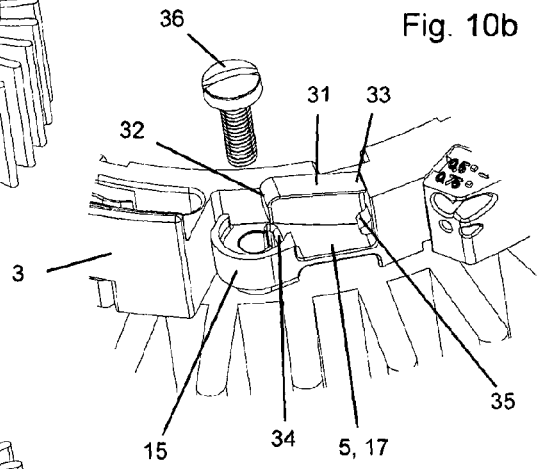
Fig. 11a
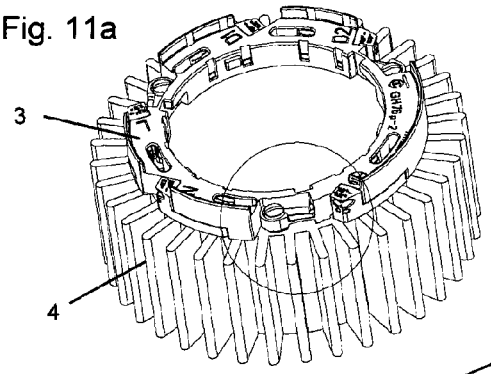
Fig. 11b
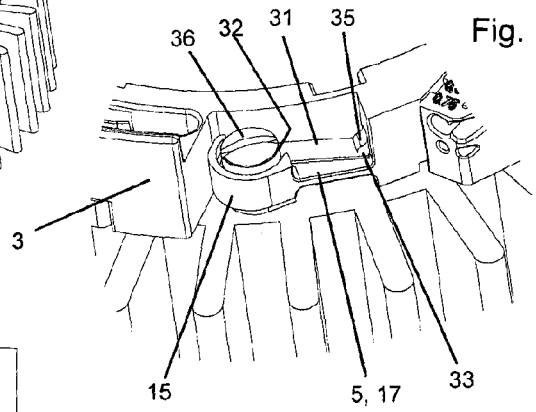
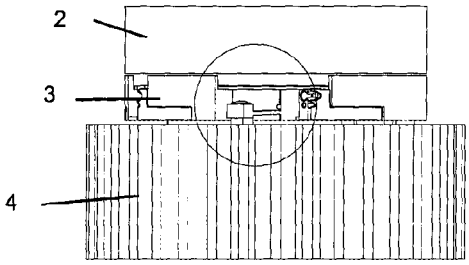
Fig. 12a
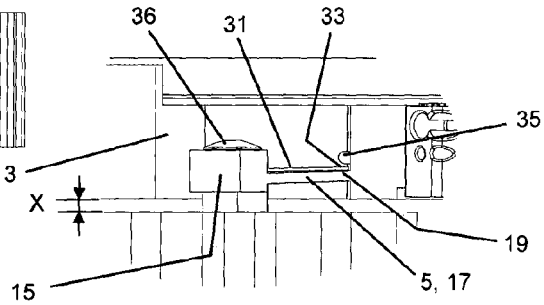
Fig. 12b

DEVICE FOR FASTENING AND CONTACTING A LIGHTING MEANS AND/OR A LIGHTING MODULE, AND LAMP

FIELD OF THE INVENTION

The invention relates to a device for fastening and contacting a lighting means and/or a lighting module, in particular an LED module and to a lamp, in particular in the form of a downlight, having such a device.

BACKGROUND

Such devices are used for fastening at least one lighting means and/or lighting module, in particular LED module, and contacting to a voltage supply. Said devices are also connected to a lamp.

Devices for LED modules, also referred to as LED light engines, are known from the prior art, which make it possible for the LED module rear side to be pressed onto a heat sink area. This is intended to be performed using a defined force in order to be able to ensure necessary heat dissipation. As a result, the life of the LEDs is influenced. The device has a lampholder housing with at least one outer ring and one inner ring, which is mounted in the outer ring with a plurality of separate compression springs, screws and washers distributed in the perimeter. Owing to the resilient mounting of the inner ring, the rear side of the LED module is pressed onto a heat sink. The inner ring is intended to be produced from a plastic which is resistant to high temperatures owing to the generation of heat of the LED module. This is disadvantageous for cost reasons.

DE 20 2009 012 000 U1 describes a device which is intended to ensure a uniformly distributed contact pressure over the mutual bearing faces of the LED module and the heat sink. This takes place by virtue of the configuration of the electrical contact which is produced between the lamp holder contacts and the contacts of the LED module by means of the formation of contact in a manner which is free of counter-forces in respect of the contact-pressure force. One disadvantage consists in that the electrical contact is nevertheless loaded.

SUMMARY

An object of the invention is configuring and developing a device for fastening and contacting a lighting means and/or lighting module, in particular an LED module, in such a way that it eliminates the mentioned disadvantages, wherein the configuration of the device is intended to be simplified and save on costs. For this, the required contact pressure of the lighting means and/or lighting module, in particular LED module, is further intended to be ensured on the heat sink.

This object is achieved according to the invention by the features specified in the independent claims.

The device for fastening and contacting a lighting means and/or a lighting module, in particular an LED module, has at least one lampholder housing, wherein the lighting means and/or lighting module, in particular LED module, is arranged in the lampholder housing and is pressed onto a heat sink connected to the device, wherein this pressing takes place at least via spring means of the device.

An essential feature of the device is that the spring means are formed integrally with the lampholder housing.

As a result, fewer component parts are required for the device.

Pressing the mutual bearing faces of the LED module and the heat sink is intended to be performed by means of the mechanical fastening of the device with the lighting means and/or lighting module, in particular LED module, and/or with the heat sink.

The required contact pressure is dependent, inter alia, on the design of the lighting means and/or lighting module, in particular LED module, and also on its electrical contacts. The less contact pressure is required, the easier it is to configure the spring means.

In accordance with the invention, fastening means or locking means for the lighting means and/or lighting module, in particular LED module, are provided in the device. It is preferred to provide for fitting without the use of tools. Preferably, the fastening means or locking means can be mechanical fastening means or mechanical locking means which are configured for holding means of the lighting means and/or lighting module, in particular LED module.

The fastening of the lighting means and/or lighting module, in particular LED module, in the device can be performed via principles known per se. If the device or the lampholder housing is in the form of a ring, the principle of a bayonet closure can be used.

It is preferred to distribute the mechanical fastening between the lighting means and/or lighting module, in particular LED module, and the device over several points. Similarly, the mechanical fastening between the lighting means and/or lighting module, in particular LED module, and the heat sink can be distributed over several points.

For example, knobs can be arranged as holding means on the lighting means and/or lighting module, in particular LED module. Corresponding cutouts can be provided in the lampholder housing of the device in order that the lighting means and/or lighting module, in particular LED module, can be plugged into the lampholder housing.

Guide elements, preferably in the form of slotted locking guides, can be provided in the lampholder housing of the device, and these guide elements are used for guiding the holding means of the lighting means and/or lighting module, in particular LED module. Possible blocking or locking of the lighting means and/or lighting module, in particular LED module, in the lampholder housing can be realized by a locking stop. It could also be realized by means of a latching notch in the lampholder housing.

As a result, the LED module fastened in the device can be pressed against a heat sink, which can be arranged on or behind the device.

It is also essential that the rear side of the lighting means and/or lighting module, in particular LED module, consists of a heat-dissipating material. The heat sink is preferably formed from aluminum. If the contact-pressure force is distributed virtually uniformly over the entire contact area between the heat sink and the rear side of the lighting means and/or lighting module, in particular LED module, improved heat dissipation out of the lighting means and/or lighting module, in particular LED module, can be achieved. The greater this contact area, the better the heat dissipation can be.

It is essential to ensure a defined contact pressure between the rear side of the lighting means and/or lighting module, in particular LED module, and the heat sink. Depending on the light management of the lighting means and/or lighting module, in particular LED module, and/or depending on the product specifications, contact-pressure forces of approximately 8N to approximately 75N can be necessary or sufficient.

The lampholder housing can be designed to be partially biased, wherein this effect can be achieved by the inclusion of spring means, which are integrated in the lampholder housing.

It is advantageous here that the spring means are formed integrally with the lamp holder housing. By minimizing the number of necessary individual components, a substantial reduction in the fitting costs is provided.

The lampholder housing is preferably made of plastic. According to the invention, the spring means can be made from the same material as the lampholder housing.

If a low contact-pressure force of the lighting means and/or lighting module, in particular LED module, on the heat sink is sufficient, the spring means do not necessarily need to be too powerful, with the result that they can be formed integrally with the lampholder housing.

The spring means can in particular be formed so as to be biased in a direction perpendicular to the contact face of the heat sink with the lighting means and/or lighting module, in particular LED module. It corresponds to the direction of the required contact-pressure force.

There are several possibilities for the arrangement of the spring means in the lampholder housing. Preferably, the spring means can act between the lampholder housing and the lighting means and/or lighting module, in particular LED module, or between the lampholder housing and the heat sink. It is important that there is sufficient contact between the lighting means and/or lighting module, in particular LED module, and the heat sink in order to dissipate the heat of the LEDs from the lighting means and/or lighting module, in particular LED module.

The spring means can be in the form of spring elements.

The device has locking means for mechanically fastening the lighting means and/or lighting module, in particular LED module. These locking means are arranged in the lampholder housing. The spring means can be provided in the locking means.

This first possibility demonstrates that the application of a contact-pressure force of the lighting means and/or lighting module, in particular LED module, on the heat sink can take place via the locking means. It can even take place exclusively via the locking means.

In this first embodiment of the invention, the locking means can be formed in a biased manner and integrally with the lampholder housing.

The locking means can have at least one slotted locking link, which is biased. In this case, the slotted locking link forms the spring means. As already mentioned above, the holding means of the lighting means and/or lighting module, in particular LED module, are held by the locking elements. Owing to the resilient mounting of these locking elements according to the invention, a contact-pressure force is exerted on the holding means, i.e. on the lighting means and/or lighting module, in particular LED module, with the result that the lighting means and/or lighting module, in particular LED module, is pressed onto the heat sink.

For this embodiment it is necessary to consider that a fixed fastening between the lampholder housing and the heat sink is intended to be provided.

The reverse case should not be ruled out. The spring means can be formed, for example, integrally with the lighting means and/or lighting module, in particular LED module, wherein the holding means can be designed in a resilient manner for fastening to the lampholder housing and the locking means of the lampholder housing can be rigid.

It is also known from the prior art that the device has fastening means for mechanically fastening the device on the heat sink. In a second embodiment of the invention, the spring means can be arranged on these fastening means.

Preferably, in each case, one spring means can be provided between the fastening means of the device with respect to the heat sink and the lampholder housing. For example, these respective spring means can be in the form of lugs.

In this embodiment, the mechanical fastening between the lighting means and/or lighting module, in particular LED module, can take place as in the previous prior art, wherein, in the fitted state of the lighting means and/or lighting module, in particular LED module, a fixed connection is provided between these two elements in the lampholder housing.

The subject matter of the invention also includes that additional spring means to the integral spring means can be provided in or on the lampholder housing.

Particularly when relatively high forces are required in order to be able to press the LED module onto the heat sink, it is advantageous if further spring means are provided. If the integral spring means are formed from plastic as is the case for the lampholder housing, it may arise that they can apply less force over time and/or that the configuration of the integral spring means is insufficient for the required spring force. This can also arise at relatively high temperatures, which can occur owing to the heating of the LEDs or the ambient temperature, wherein the plastic of the lampholder housing and the integral spring means would degenerate.

The additional spring means are intended to have a supporting effect with respect to the spring means, i.e. the additional spring means are intended to be stronger than the integral spring means. A higher contact-pressure force can thus be achieved. Depending on the properties of the integral spring means and the additional spring means, a contact-pressure force which is up to approximately 10 times greater can be achieved.

Owing to the configuration of the spring means, i.e. owing to their geometry and their material properties, the required contact-pressure force can be achieved. For example, various spring means can be provided which each having a different thickness in order to provide the possibility of different contact-pressure forces, depending on which contact-pressure force is required for the respective products.

The additional spring means can also be formed integrally with the lampholder housing or as an additional element. They can be made from the same material as the integral spring means. However, they can preferably also be made of a material having a higher spring force, in particular spring steel. As a result, relatively high temperatures can be withstood more effectively and the contact-pressure force of the LED module on the heat sink remains more uniformly distributed.

It is preferred that the additional spring means are arranged directly with respect to the integral spring means. They can be provided, for example, virtually or substantially parallel to the integral spring means.

Preferably, the additional spring means can be fastened or locked at least on one side with the lampholder housing. The other side of the additional spring means can be arranged so as to be mounted in the lampholder housing, for example.

It would also be conceivable for the integral spring means to be made from a different material than that of the lampholder housing. For example, the lampholder housing can be made from plastic, and the integral spring means from spring steel, wherein, when producing the device, these spring means can be integrally connected to the lampholder housing, for example by means of encapsulation by injection molding.

In further embodiments, provision can also be made for spring means to act between the lampholder housing of the device and the lighting means and/or lighting module, in particular LED module, or for spring means to act between the lampholder housing of the device and the heat sink, wherein the spring means are provided as additional elements to the lampholder housing of the device. Such spring means can be connected, at least at one of their ends, to the lampholder housing of the device or can be mounted in or on the lampholder housing of the device. The possibility of the integral spring means being dispensed with in these embodiments is conceivable. Primarily, the spring means can be selected as additional elements such that the required contact-pressure force of the lighting means and/or lighting module, in particular LED module, on the heat sink is achieved. The material and geometry of the spring means can be selected correspondingly, wherein spring steel can be preferred as material. Further advantages resulting from the other described embodiments can also be taken into consideration for such embodiments. The possibility of combining features from the other described embodiments with such embodiments is also not ruled out.

Further embodiments of the spring means and the additional spring means are not described here, however, they should not be excluded from the invention.

In a further aspect of the invention, the electrical contact between the device and the lighting means and/or lighting module, in particular LED module, is provided via further means than those for the mechanical fastening between the device and the lighting means and/or lighting module, in particular LED module.

In addition, a device for fastening and contacting a lighting means and/or a lighting module, in particular an LED module, is provided wherein the device has at least one lampholder housing, wherein the lighting means and/or lighting module, in particular LED module, is arranged in the lampholder housing of the device and is pressed onto a heat sink connected to the device, and wherein the device has a connection to ground.

It is essential that the connection to ground is contacted by the lampholder housing directly on the heat sink. The connection to ground can be resilient. It can also be provided as a wire clip.

In a further essential feature of the invention, the device for fastening and contacting a lighting means and/or a lighting module, in particular an LED module, is connected indirectly or directly to a lamp. A downlight lamp can be provided as the lamp, for example.

The invention also relates to a lighting means or lighting module, in particular LED module, and to a lamp having the device according to the invention.

BRIEF DESCRIPTION OF THE DRAWINGS

The invention will be described in more detail below with reference to embodiments which are intended to be interpreted merely by way of example, with no restrictive effect, however.

In the drawings:

FIG. 10*a* shows a perspective view of the second device according to the invention comprising as yet unfitted additional spring means.

FIG. 10*b* shows a detail view of the spring means shown in FIG. 10*a*.

FIG. 11*a* shows a perspective view of the second device according to the invention comprising fitted additional spring means, wherein the LED module (not illustrated) has not yet been fitted in the device.

FIG. 11*b* shows a detailed view of the spring means shown in FIG. 11*a*.

FIG. 12*a* shows a side view of the second device according to the invention comprising additional spring means, wherein the LED module is fitted in the device.

FIG. 12*b* shows a detailed view of the spring means shown in FIG. 12*a*.

DETAILED DESCRIPTION OF THE PREFERRED EMBODIMENTS

Figure 1B:
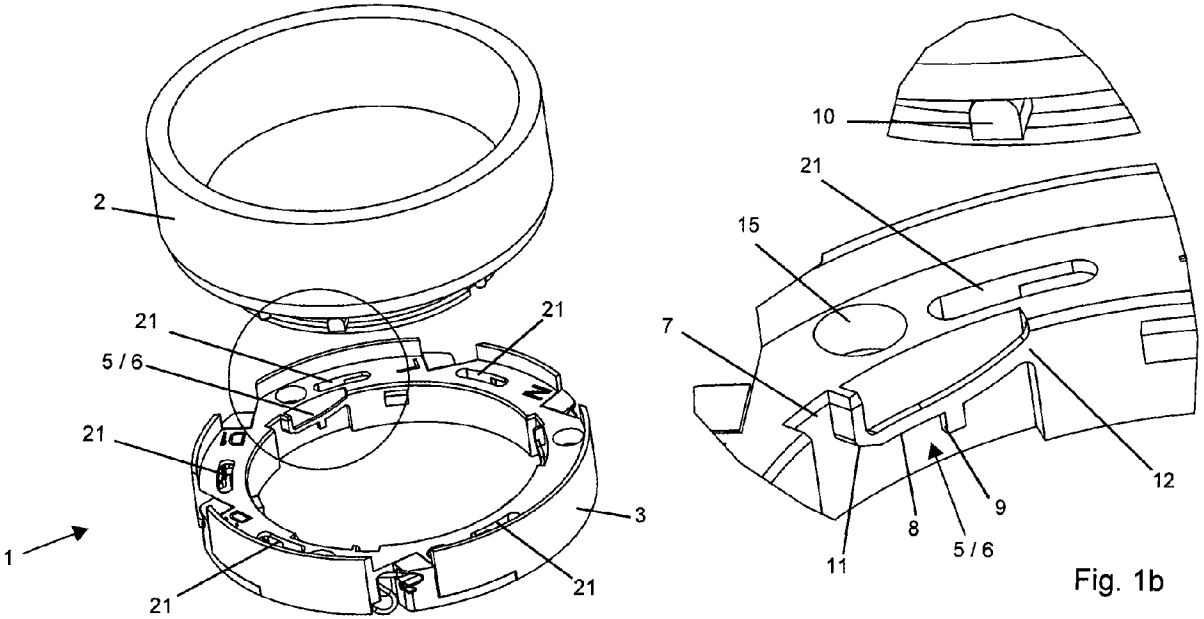
FIG. 1*b* shows a detailed view of the spring means shown in FIG. 1*a*.
Figure 1A:
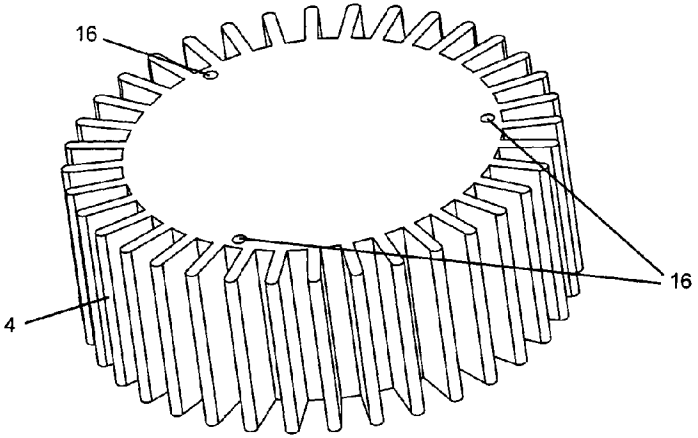
FIG. 1*a* shows an exploded view of a first device according to the invention comprising an LED module and a heat sink.
Figure 3:
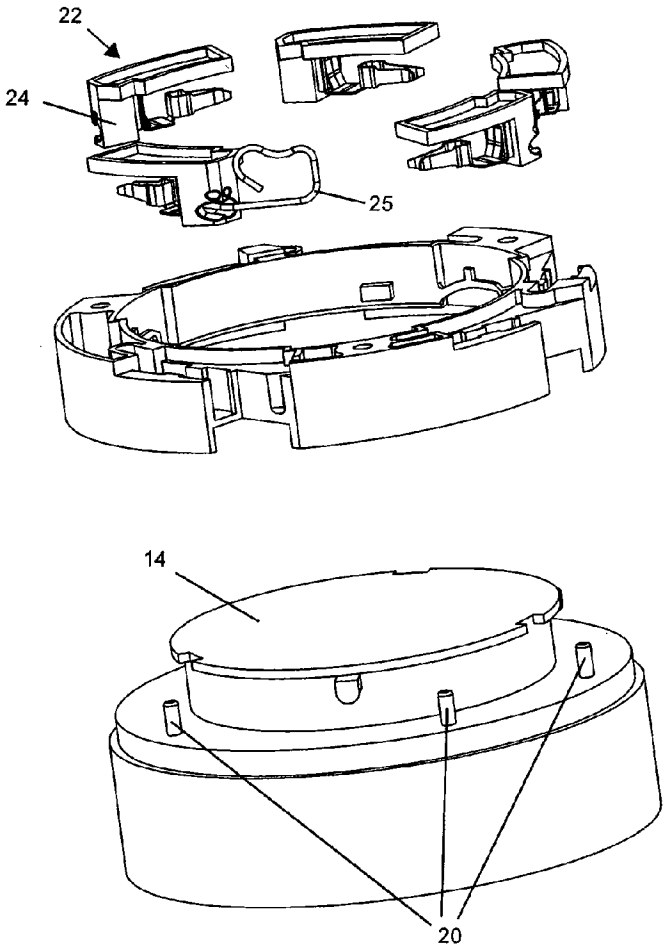
FIG. 3 shows a further exploded view of the first device according to the invention comprising an LED module.
Figure 2:
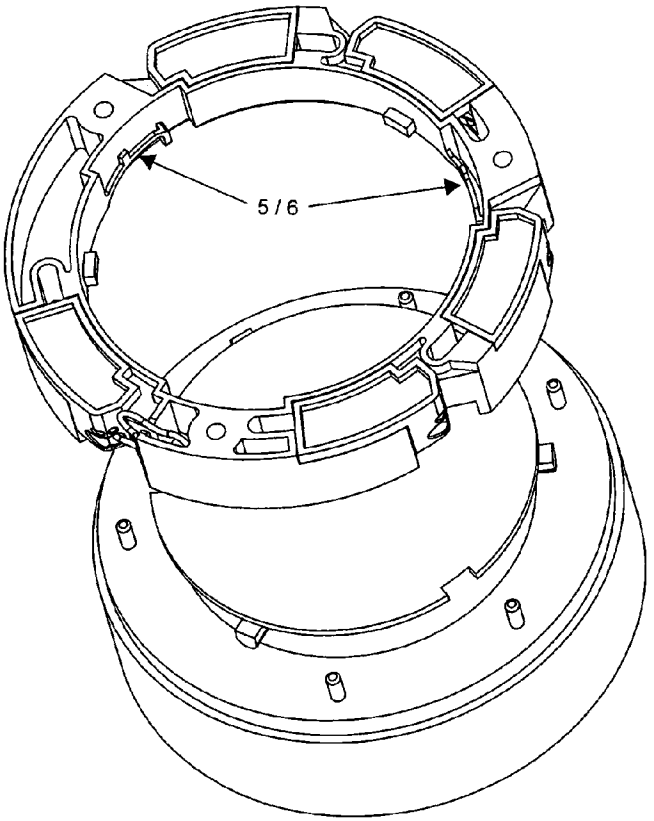
FIG. 2 shows an exploded view of the first device according to the invention comprising an LED module.
Figure 4A:
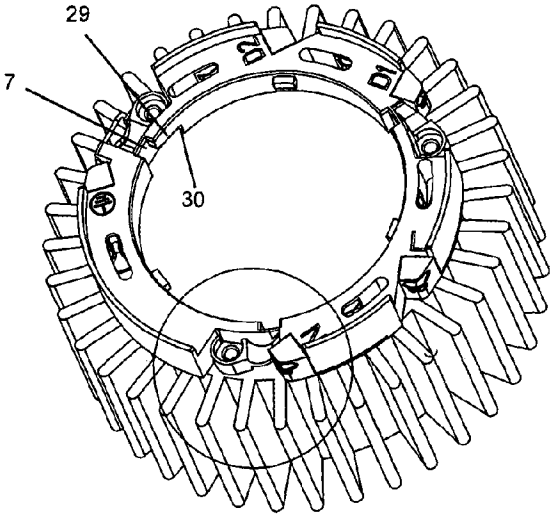
FIG. 4*a* shows a perspective view of a second device according to the invention comprising a heat sink.
Figure 4B:
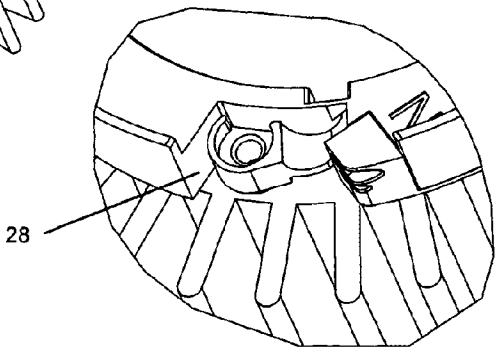
FIG. 4*b* shows a detail view of the spring means shown in FIG. 4*a*.
Figure 5:
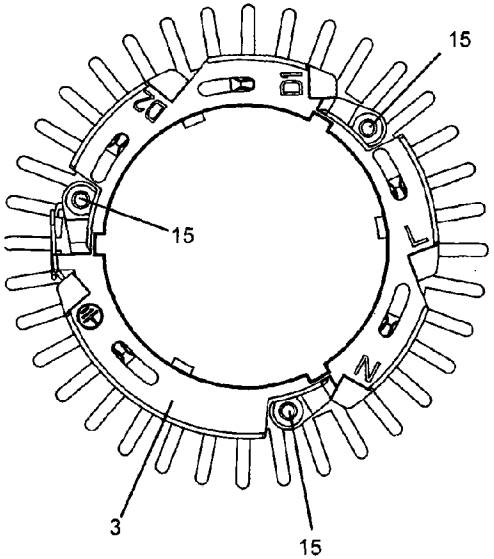
FIG. 5 shows a view from above of the second device according to the invention comprising a heat sink.
Figure 6A:
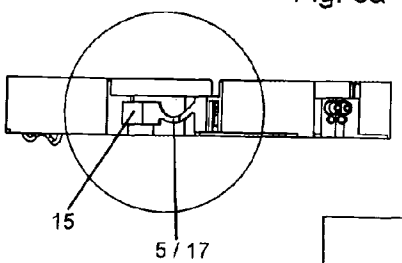
FIG. 6*a* shows a side view of the second device according to the invention.
Figure 6B:
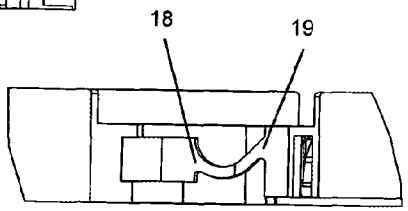
FIG. 6*b* shows a detailed view of the spring means shown in FIG. 6*a*.
Figure 8:
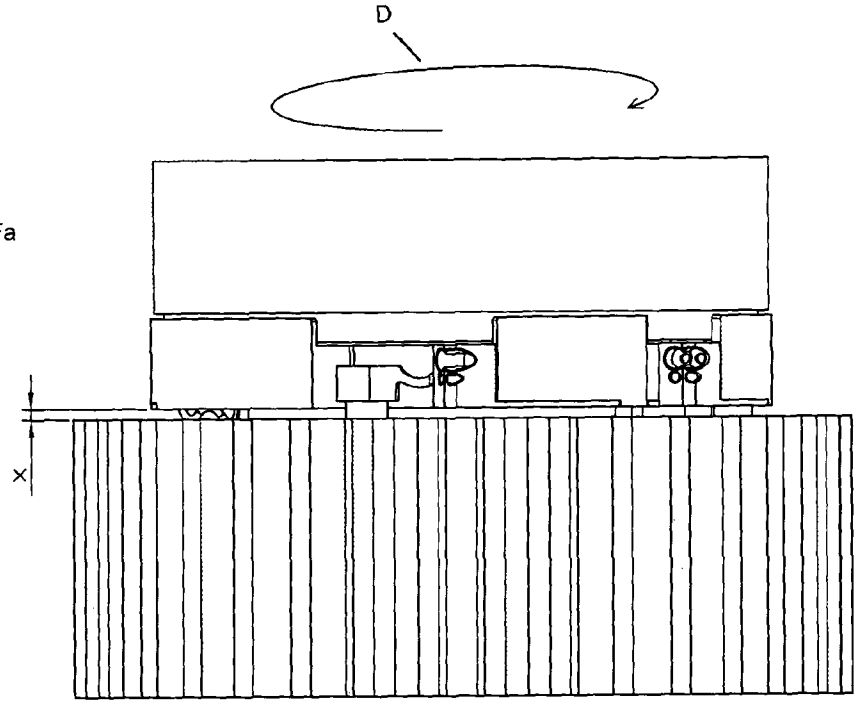
FIG. 8 shows a side view of the second device according to the invention comprising an LED module and a heat sink, wherein the LED module is fastened in the device.
Figure 7:
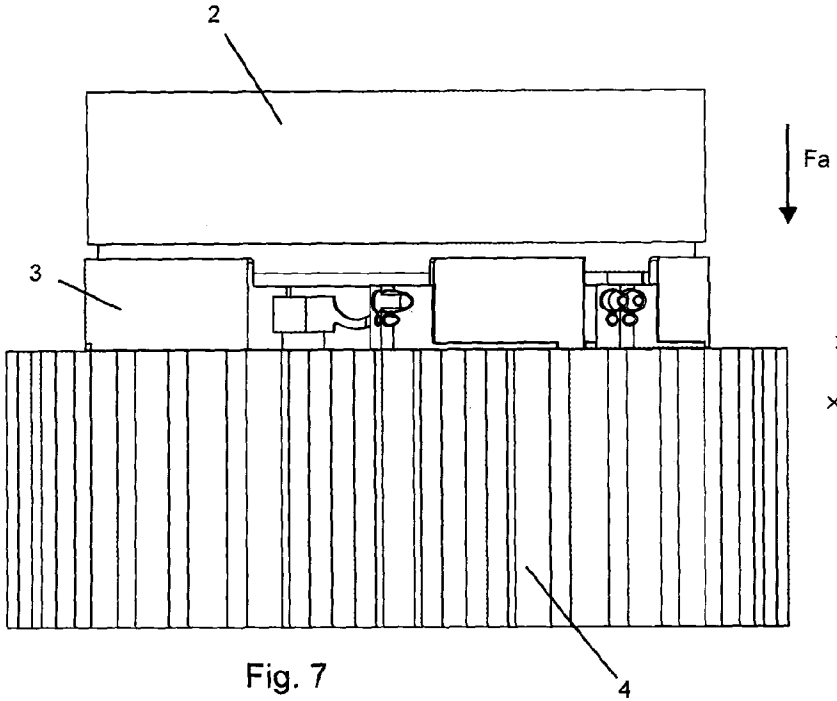
FIG. 7 shows a side view of the second device according to the invention comprising an LED module and a heat sink, wherein the LED module has not yet been fastened in the device.

FIG. 1*a* shows a device 1 according to the invention and an LED module 2 and a heat sink 4. Only LED modules 2 are described here, but this should not rule out the possibility of other lighting means or lighting modules being used.

The device 1 comprising the LED module 2 and the heat sink 4 are generally part of a lamp. In this case, this could be a downlight lamp. Further types of lamp are nevertheless not intended to be ruled out of this invention.

Heat sinks are preferably made from aluminum and are required during the use of LEDs or LED modules in order to dissipate the heat generated by the LEDs.

FIGS. 1*a* to 3 show a first variant of the device 1 according to the invention. The device 1 has a lampholder housing 3. This lampholder housing 3 can be fastened on the heat sink 4. The connection can be performed by fastening means 15 and 16, for example, in this case in the form of screw holes for fastening screws (not illustrated here). The fastening means 15 are preferably distributed regularly over the lampholder housing 3, and the fastening means 16 are distributed on the heat sink 4, corresponding to the fastening means 15 of the lampholder housing 3. The device 1 is thus fixedly and rigidly connected to the heat sink 4.

Then, the LED module 2 can be fitted into the device 1. This is associated with the advantage that only the lighting means and/or the lighting module, in particular LED module 2, is intended to be replaced if this should be necessary. The device 1 can remain in its fitted state. This simplifies fitting and disassembly for trained personnel, primarily when the lighting means and/or lighting module is provided as a downlight.

The mechanical connection of the LED module 2 to the device 1 or to the lampholder housing 3 can preferably be performed via a bayonet principle. In this case, the LED module 2 is also locked in the device 1 or in the lampholder housing 3 in this way.

The LED module 2 has knobs 10. These knobs are preferably arranged distributed around the LED module 2.

When fitting the LED module 2 into the device 1, the knobs 10 are plugged into the cutouts 7 in the lampholder housing 3 and then the LED module 2 is rotated in the direction of rotation in accordance with a bayonet principle. The knobs 10 are guided and locked via the locking means 6. As a result, the LED module 2 is mechanically fixed in the device 1. The knobs 10 slide along the slotted locking guide 8 of the locking means 6 as far as the stop 9 of the locking means 6.

Each locking means 6 is integrally connected with its two ends 11 and 12 to the lampholder housing 3. The locking means 6, primarily the slotted locking links 8, are resilient, and the knobs 10 of the LED module 2 are pressed in the direction of the contact-pressure force in order that the LED module 2 can be held pressed against the heat sink 4. The locking means 6 in this case at the same time form the spring means 5, which are intended to provide the possibility of the LED module 2 being pressed onto the heat sink 4.

The lampholder housing 3 is preferably made from plastic. As a result, the locking means 6 are made from the same material.

FIGS. 4*a* to 8*b* illustrate a second variant of the device according to the invention.

The mechanical locking of the LED module 2 to the device 1 can be performed in a manner known per se. The knobs 10 of the LED module 2 can be plugged into the respective cutouts 7 in the lampholder housing 3. The LED module 2 can be rotated in accordance with a bayonet principle, wherein the knobs 10 of the LED module 2 each slide along a rigid slotted locking link 29 and can be guided and can each be locked by a locking stop 30.

In turn, the device 1 can, for this embodiment, be connected via fastening elements 15 to the fastening elements 16 of the heat sink 4 by means of fastening screws (not illustrated here).

In this embodiment, the spring means 5 are formed by lugs 17 between the fastening elements 15 of the device 1 and the lampholder housing 3. The lugs 17 are resilient.

The lugs 17 are formed integrally with the lampholder housing 3 and preferably also integrally with the respective fastening elements 15. One end 18 of a lug 17 can be connected in the upper part of a fastening element 15 and the other end 19 of this lug 17 can be connected to the lampholder housing 3.

In order to keep the biased movement of the lampholder housing 3 free from the fastening elements 15 of the device 1, cutouts 28 in the lampholder housing 3 can be provided around the fastening elements 15.

Before the LED module 2 is screwed into the lampholder housing 3, i.e. as long as the LED module 2 is only plugged into the lampholder housing 3, the lampholder housing 3 rests on the contact area 13 of the heat sink 4.

When the LED module 2 is screwed into the lampholder housing 3 in the direction of rotation D, the lampholder housing 3 rises from the contact area 13 of the heat sink 4 by a distance X, and the rear side 14 of the LED module 2, which rear side preferably consists of heat-dissipating material, is pressed onto the contact area 13 of the heat sink 4 owing to the biased mounting of the lug 17.

The electrical contact between the LED module 2 and the device 1 can be provided in a manner known per se. In this case, for example, the LED module 2 has contact pins 20, which are positioned around the LED module 2 and are arranged in a direction perpendicular to the rear side 14 of the LED module 2. During fitting of the LED module 2 into the device 1, the contact pins 20 are plugged into the slots 21 in the lampholder housing 3 and, by virtue of the rotatory movement for the mechanical locking, they are contacted with electrically conducting contacting elements 22. The contact pins 20 are clamped into the respective contact clamps 23. These contact clamps 23 are each electrically connected to a wiring contact 24, wherein further electrical wiring is possible.

In this case, five contact pins 20 are provided. The number of contact pins can be dependent on the desired connections.

The required contact-pressure force is primarily dependent on the light management of the LED module 2, i.e. it is dependent on how much heat comes out of the LED module. A guideline value can be considered to be a contact-pressure force of approximately 10N to 20N in order to be able to dissipate the heat out of the LED module 2 sufficiently.

Good light management or little heat from the LED module 2 enables a simplified design of the spring means 5. They can be formed integrally with the lampholder housing 3 and do not need to be implemented as an additional component part with respect to the lampholder housing 3. The fitting of the device is thus simplified and favorable production of the device results.

Figure 9B:
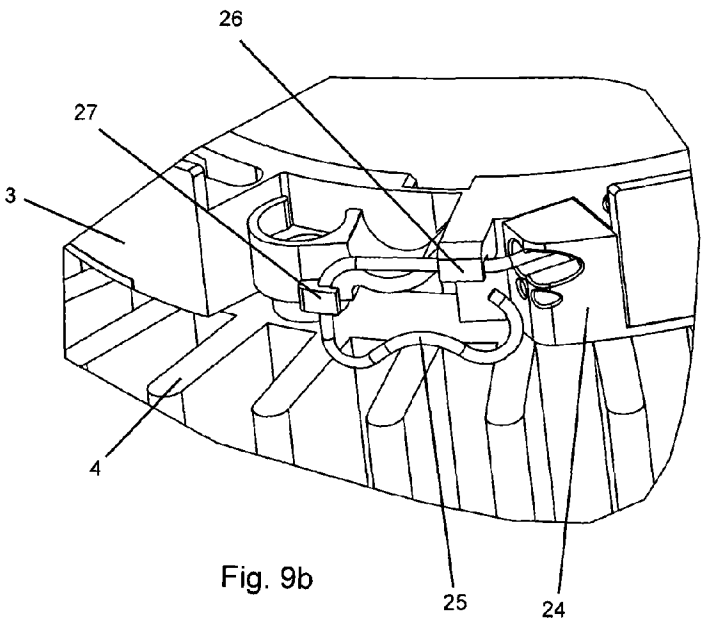
FIG. 9*b* shows a detailed view of the connection to ground shown in FIG. 9*a*.
Figure 9A:
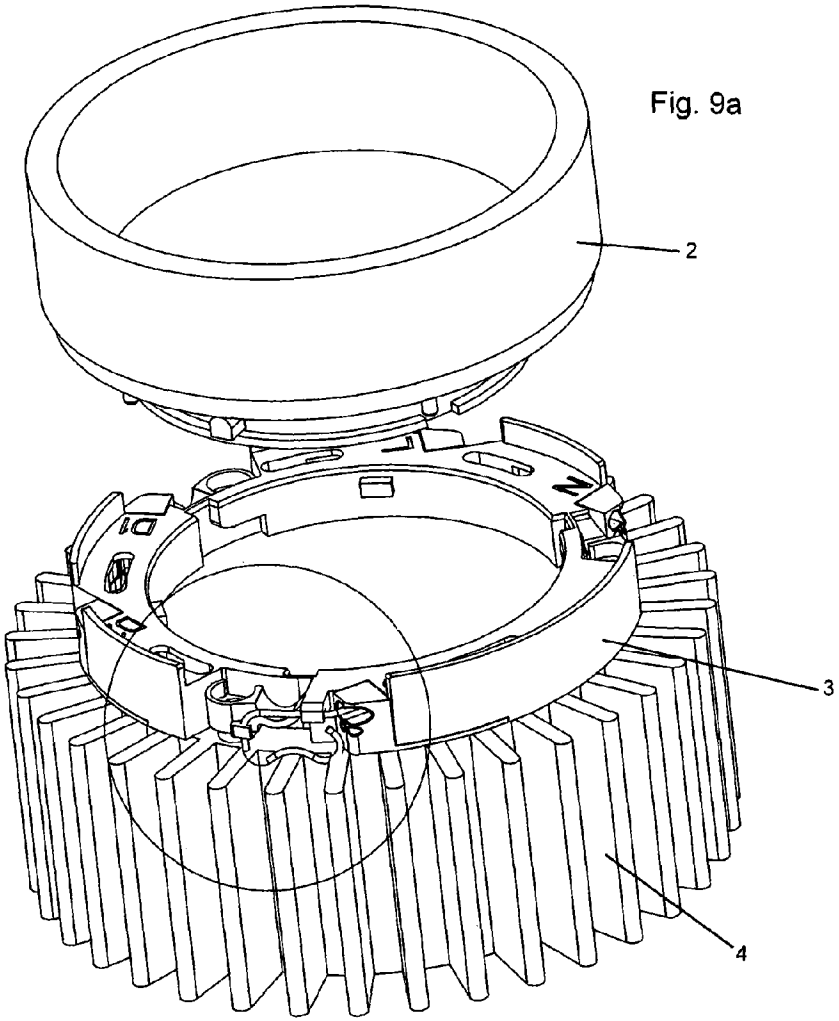
FIG. 9*a* shows a perspective view of the second device according to the invention comprising a heat sink and an as yet unfitted LED module.

FIGS. 9*a* and 9*b* show a possible embodiment of a connection to ground 25 of this unit (LED module 2 with device 1 and heat sink 4). A connection to ground 25 can be required for LED modules, depending on regulations. From the LED module 2, there is a contact pin 20 for grounding the LED module 2, which contact pin is electrically contacted to the contacting element 22. The connection to ground 25 can be further wired from the contacting element 22, which is arranged in the lampholder housing 3, preferably out of its wiring contact 24.

The connection to ground 25 can preferably be a wire clip. It is preferably resiliently biased. The connection to ground 25 can thus be contacted directly on the heat sink 4. Owing to its spring properties, good grounding contact of the LED module 2 with the heat sink 4 is provided.

Holding elements 26 and/or 27 can be provided which are arranged on the lampholder housing and/or on the fastening element 15 of the device 1. The connection to ground 25 in the form of a wire clip can be guided by these holding elements 26 and 27.

FIGS. 10*a* to 12*b* show an exemplary variant of the previously described second embodiment with additional spring means. The additional spring means 31 can be formed from spring steel.

A first end 32 of the spring means 31 is fastened indirectly and/or directly to the fastening means 15 of the device 1. In this case, the end 32 of the spring means 31 is bent and is positioned in a slit 34 in the region of the fastening means 15 or at the first end 18 of the integral spring means 5, 17. When fitting the lampholder housing 3 on the heat sink 4 by means of the screws 36 in the fastening means 15, the screws 36 lock or fasten the end 32 of the spring means 31, wherein the screw head protrudes beyond the end 32 of the spring means 31 or is on the bend of the spring element 31. As a result, the spring means 31 are fixed at least on one side to the device, in this case to the fastening elements 15.

The fastening housing 3 has bearing means, in this case illustrated as knobs 35, which are arranged in the region of the second end 19 of the spring means 5, 17. The second end 33 of the spring means 31 can be arranged or mounted in the region of the bearing means, in this case in the form of knobs 35. It is not essential that this end 33 of the spring means 31 is fixed. The free end 33 of the spring means 31 can be provided, for example, between the knob 35 and the second end 19 of the spring means 5, 17. The spring means 5, 17 and 31 can be arranged substantially parallel to one another when the LED module 2 has not yet been fitted in the lampholder housing 3. The spring force direction of the spring means 5, 17 and 31 is substantially identical.

Other possibilities for mounting or fixing the spring means 31 should not be ruled out.

If the LED module 2 is fitted in the device 1, in this embodiment the lampholder housing 3 is raised from the heat sink 4 by a distance X, and the spring means 5 and the spring means 31 can be deformed differently, as illustrated in FIGS. 12*a* and 12*b*. The spring means 5, 17 have more severe deformation than the spring means 31 since they can enable less contact-pressure force of the LED module 2 on the heat sink 4. The spring means 5, 17 and 31 are no longer parallel to one another in the fitted state of the LED module 2 owing to the different deformations. The spring means 31 support the spring means 5, 17 and improve or increase the pressure of the LED module 2 on the heat sink 4.

The second end 33 of the spring means 31 rests on the end 19 of the spring means 5, 17 in the region of the lampholder housing. The spring means 31 are downwardly tensioned.

The thickness of the spring means 31 as spring steel influences, inter alia, the contact-pressure force of the LED module 2 on the heat sink 4. It would be conceivable to have different spring means 31 with different thicknesses, for example, and to use the appropriate spring means 31 for the requirements for the lamp in the device.

The embodiments illustrated in the figures are merely examples of the invention. Further embodiments (not illustrated here) are not intended to be excluded.

DESIGNATIONS IN THE DRAWINGS

1. Device
2. LED module
3. Lampholder housing
4. Heat sink
5. Spring means
6. Locking means
7. Cutout
8. Slotted locking link
9. Locking stop
10. Knob
11. First end of 6
12. Second end of 6
13. Contact area of 4
14. Rear side of 2
15. Fastening means of 1
16. Fastening means of 4
17. Lug
18. First end of 17
19. Second end of 17
20. Contact pin
21. Slot
22. Contacting element
23. Contact clamp
24. Wiring contact
25. Connection to ground
26. Holding element
27. Holding element
28. Cutout
29. Slotted locking link
30. Locking stop
31. Spring means
32. First end of 31
33. Second end of 31
34. Slit
35. Knob
36. Screw
D: Direction of rotation
Fa: Contact-pressure force
X: Distance between 3 and 4

What is claimed is:

1. A device for fastening and contacting a lighting means and/or a lighting module, wherein the device (1) comprises at least one lampholder housing (3), wherein the lighting means and/or lighting module, is arranged in the at least one lampholder housing (3) of the device (1) and is pressed onto a heat sink (4), which is connected to the device (1), wherein said pressing is performed at least via spring means (5) of the device (1), the spring means (5) are formed integrally with the at least one lampholder housing (3), wherein an electrical contact between the device (1) and the lighting means and/or lighting module, is provided via other means (20, 22) than those used for the mechanical fastening between the device (1) and the lighting means and/or lighting module.

2. The device as claimed in claim 1, wherein the spring means (5) are formed so as to be biased in a direction perpendicular to a contact face (13) of the heat sink (4) with the lighting means and/or lighting module.

3. The device as claimed in claim 1, wherein the spring means (5) act between the at least one lampholder housing (3) and the lighting means and/or lighting module, or between the at least one lampholder housing (3) and the heat sink (4).

4. The device as claimed in claim 1, further comprising a locking means (6) for mechanically fastening the lighting means and/or lighting module in the lampholder housing (3), wherein the spring means (5) are provided in the locking means (6).

5. The device as claimed in has claim 1, further comprising fastening means (15) for mechanically fastening the device (1) on the heat sink (4), wherein the spring means (5) are arranged on the fastening means (15).

6. The device as claimed in claim 5, wherein the spring means (5) are in the form of a lug (17) between the fastening means (15) and the lampholder housing (3).

7. The device as claimed in claim 1, further comprising additional spring means (31) to the spring means (5) are provided in or on the at least one lampholder housing (3).

8. The device as claimed in claim 7, wherein the additional spring means (31) have a supportive effect with respect to the spring means (5).

9. The device as claimed in claim 7 wherein the additional spring means (31) are arranged directly with respect to the spring means (5).

10. A lamp comprising a device (1) as claimed in claim 1.

11. A device for fastening and contacting a lighting means and/or a lighting module, wherein the device (1) comprises at least one lampholder housing (3), wherein the lighting means and/or lighting module, is arranged in the at least one lampholder housing (3) of the device (1) and is pressed onto a heat sink (4), which is connected to the device (1), wherein said pressing is performed at least via spring means (5) of the device (1), the spring means (5) are formed integrally with the at least one lampholder housing (3), the device (1) further comprising a locking means (6) for mechanically fastening the lighting means and/or lighting module in the lampholder housing (3), wherein the spring means (5) are provided in the locking means (6) and wherein the locking means (6) have at least one slotted locking link (8), which is resilient.

12. A device for fastening and contacting a lighting means and/or a lighting module, wherein the device (1) comprises at least one lampholder housing (3), wherein the lighting means and/or lighting module is arranged in the at least one lampholder housing (3) of the device (1) and is pressed onto a heat sink (4) connected to the device (1), and wherein the device (1) has a connection to ground (25), the connection to ground (25) is contacted by the lampholder housing (3) directly on the heat sink (4).

* * * * *